United States Patent [19]

Yano

[11] 4,289,481

[45] Sep. 15, 1981

[54] FUEL AND APPARATUS FOR DRYING GRAIN

[75] Inventor: Robert A. Yano, Worthington, Ohio

[73] Assignee: Comet, Inc., Grand Island, Nebr.

[21] Appl. No.: 55,152

[22] Filed: Jul. 6, 1979

[51] Int. Cl.[3] ..... F27D 1/08

[52] U.S. Cl. ..... 432/96; 34/174; 110/261; 432/97

[58] Field of Search ..... 432/96, 97; 110/261, 110/262; 34/174

[56] References Cited

U.S. PATENT DOCUMENTS

| | | | |
|---|---|---|---|
| 1,333,104 | 3/1920 | Ewing | 110/261 |
| 3,393,650 | 7/1968 | Daman et al. | 110/261 |
| 3,896,562 | 7/1975 | Zimmerman | 34/174 |
| 3,950,143 | 4/1976 | Pyle | 44/10 C |
| 4,139,952 | 2/1979 | Stanfield | 34/174 |
| 4,147,115 | 4/1979 | Leppert | 110/261 |
| 4,149,844 | 4/1979 | Noyes | 34/174 |

FOREIGN PATENT DOCUMENTS

| | | | |
|---|---|---|---|
| 2621004 | 11/1977 | Fed. Rep. of Germany | 432/96 |

*Primary Examiner*—John J. Camby

*Attorney, Agent, or Firm*—Berman, Aisenberg & Platt

[57] ABSTRACT

Finely-divided grain products in general and grain dust in particular are useful fuels which are advantageously employed in the drying of harvested grain to a moisture content suitable for storage and/or further processing. A grain dryer designed for such fuels provides for preheating and predrying fuel prior to feeding it to a burner.

6 Claims, 1 Drawing Figure

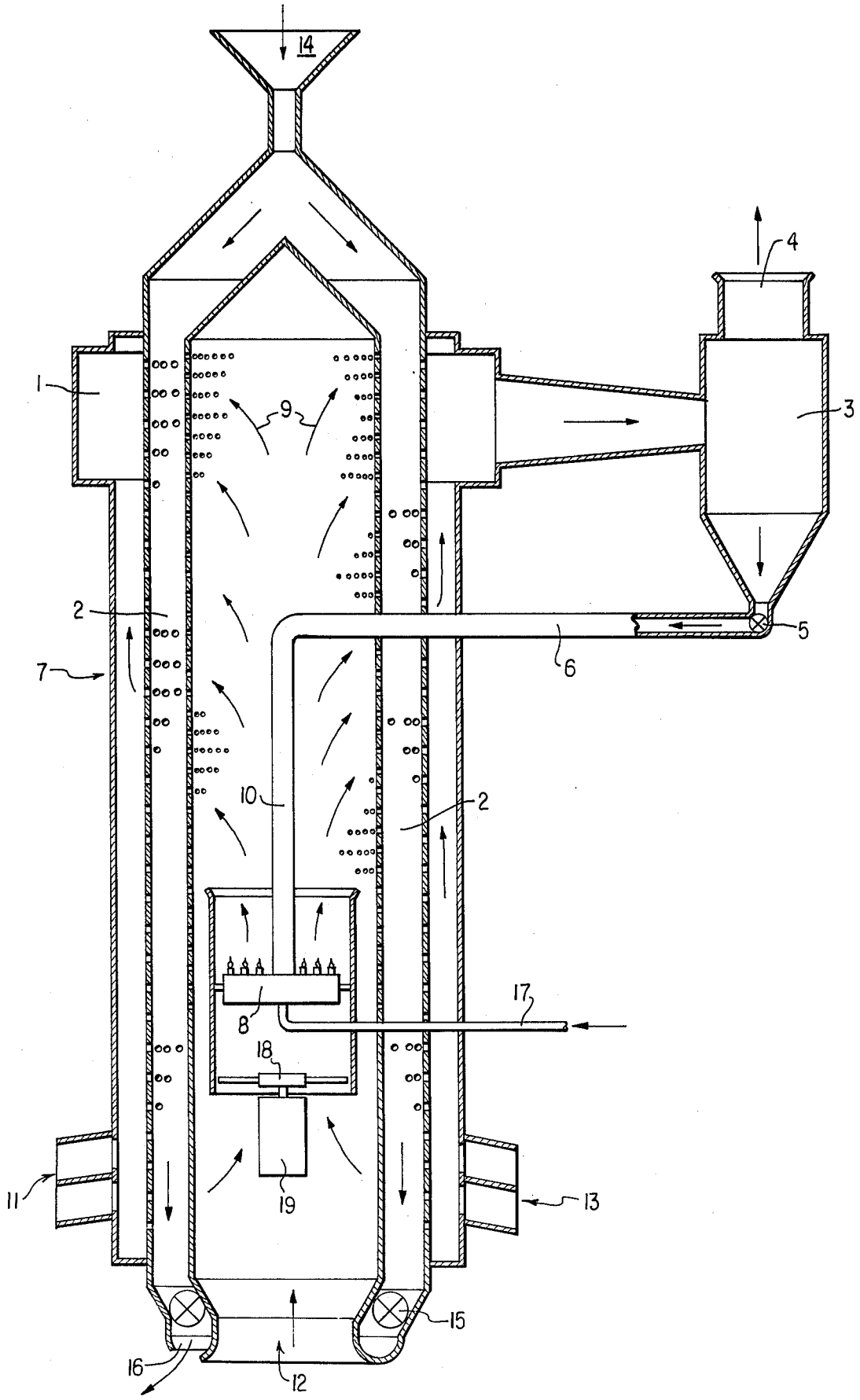
14
4
1
9
3
2
5
7
6
10
2
17
8
18
11
19
13
15
16
12

FUEL AND APPARATUS FOR DRYING GRAIN

THE TECHNICAL FIELD

After harvesting, grain is ordinarily dried to a safe moisture content (about 10 to about 12 percent) for storage. This invention primarily concerns particular fuel for drying such grain and apparatus designed to use such fuel efficiently.

Before grain is placed in storage, it is dried to what is regarded as a safe moisture content; otherwise it is subject to spoilage or attack by insects and/or other pests. After harvest, grain is often permitted to dry naturally in the field, but this presents certain inconveniences. In addition to the fact that the weather may not cooperate, there is a period of inactivity for workers. By drying the grain with suitable equipment, the workers are kept busy until the grain is in storage, and the moisture content of the dried grain can be more accurately controlled.

BACKGROUND

The use of coal dust and other powdered solids as fuel has long been known (U.S. Pat. No. 1,926,304, Sept. 12, 1933; *Power,* Volume 80, pp. 258 and 259, May 1936; *Power,* March 1974; "Mechanical Engineering", page 55, March 1976; U.S. Pat. No. 3,950,143, Apr. 13, 1976). The adaptation of specific powdered solids as fuels for single- or variable-speed engines or for furnaces has not been fully developed.

The cost of energy (dollars per million BTU's) from the burning of corn and wheat is comparable to that from oil, gasoline and liquified gas, but much higher (two to three times) than that from coal. Grain dust (emissions) represents about 0.4 percent of the total U.S. grain production (1.6 million metric tons out of 414 million metric tons). The 1.6 million metric tons of grain dust (emissions) at 8000 BTU/lb (dry) represents only 0.13 percent of the energy content of the 800 metric tons of coal, at 12,000 BTU/lb, to be produced in the U.S. in 1980. The available grain dust emissions are projected as a viable fuel source for the approximately 8,000 country, inland terminal and port terminal grain facilities located throughout the United States. They provide a safe, nonpolluting way to eliminate a very dangerous pollution source. At an essentially zero resource cost, they provide a substantial reduction in grain-elevator heating and/or power costs.

INVENTION

In order to prevent any delay between harvesting grains and placing it in storage or further processing it, the grain can be artificially dried to the desired moisture content. Harvested grain may have a moisture content between 20 and 25 percent or even higher, whereas a safe moisture content for storage is between 10 and 12 percent. For grain that is being processed for use, the actual desired moisture content may vary from grain to grain.

Although the final moisture content is controlled by artificial drying, the cost of fuel for such drying and bringing the fuel on location are material factors in the use of this procedure.

However, in view of the heat content of grain dust, which is readily available, pulverized corn (shelled dry) or pulverized dry wheat straw, these materials are suitable fuels for drying harvested grain prior to storage or use. Such drying must naturally be effected in apparatus designed and suitable for such purpose.

Although ground corn and wheat are not competitive in price with coal on an energy basis, grain dust surely is, and none of the grain-derived fuels require separate storage and separate bringing onto location.

There is a particular advantage of using grain dust for on-site drying of the same grain, e.g. wheat, corn, soybeans and oats, from which the grain dust evolved. The drying of grain reduces transportation weight, reduces storage volume, increases storage life (less spoilage), produces a higher-quality product and reduces insect problems.

BRIEF DESCRIPTION OF THE DRAWING

The sole FIGURE of drawing is a vertical cross section of a grain-dust-emissions grain dryer.

DETAILS

Although the ability to burn is a critical factor in the selection of a fuel, it is far from the sole such factor. The heat content, cost and the controllability of burning are material considerations for the selection of any fuel. The mere fact that grain or other dusts have been involved in explosions does not qualify such dusts as practical fuels for any purpose. Pulverized coal has been successfully used as a fuel. It is used for heating purposes and for running internal combustion engines. Grain dust and other finely-divided (pulverized) grain products are suitable fuels, and some relevant data are presented in Table 1 comparing these fuels with more commonly-used fuels.

A regularly-encountered problem in the harvesting of grain concerns the drying of harvested grain to a moisture content suitable for storage or for milling. Harvested grain ordinarily has a moisture content of between 20 and 25 percent by weight, and this should be reduced to somewhere between 10 and 15 percent by weight prior to placing the grain in storage. Otherwise, previously-noted problems are encountered, and the shelf-life of the grain leaves much to be desired. Also, the preferred moisture content of grain at the time of milling actually varies from grain to grain. It is thus advantageous to have a means of drying grain to yield a product having the desired moisture content.

Suitable burners or ovens are available for drying harvested grain for storage and/or for milling. However, these require the purchase and storage of fuel. Grain dust is a byproduct which serves virtually no useful purpose and is available for use as fuel in drying harvested grain when used in an appropriate grain dryer. Also, other finely-divided grain is similarly useful.

The use of grain dust or pulverized grain for drying grain is particularly advantageous since the grain dust and/or grain is readily available wherever grain is harvested. There is no need either to obtain or store other fuel. The economic advantages are thus multiplied when pulverized grain or grain dust is used in this manner. In the event of a shortage of grain dust, grain can be pulverized on location and economically used as fuel in a suitable grain dryer.

A grain dryer specifically designed for the use of grain dust as fuel is illustrated in the drawing.

With reference to the drawing, which is a partially-schematic vertical cross section of a grain-dust emissions grain dryer, grain dust (fuel) enters the dryer at 1 and is carried around the outside of a porous annulus 2 to a separator (cyclone and/or filter screen) 3, from which clean air is discharged (wet) at 4. The separated grain dust is passed by feeder 5 through a feed line 6 into the dryer 7 through air heated by the burner prior to reaching burner 8. The burner is thus fed with grain-dust fuel which is dried to a suitable moisture content (advantageously at most 5 percent by weigth) with heat from the burner itself. Hot air 9 from the burner surrounds and heats the grain-dust pre-heater and dryer 10 and passes through the porous annulus 2, thus drying wet grain conducted therethrough.

Cool air for the burner and for cooling dried grain enters at 11, 12 and 13.

After the burner is fired and the dryer attains a predetermined temperature, wet grain is charged at a convenient rate at inlet 14 and passes through annulus (grain column) 2 (wherein it is dried to the desired degree for passing through discharge feeder 15 to outlet 16).

To assist in starting the burner, an auxiliary fuel supply line 17 is optionally provided for. Also the placement of a fan 18 and motor 19 (to drive the fan) beneath the burner is useful for directing hot air around and through grain column 2.

The FIGURE is merely illustrative of the type of grain dryer in which grain dust or pulverized grain is useful as fuel.

INDUSTRIAL EXPLOITATION

An attractive application for using grain dust as fuel is the on-site drying of the grain, e.g. corn, wheat, soybeans or oats, from which the grain dust evolved. Even though grain-dust emissions represent only about 0.4 percent (by weight) of all grain handled, an increase of available grain dust to from 1 to 2 percent of grain handled is expected with the increasingly stringent air-pollution requirements and with the incentive, i.e. alternative fuel, to remove the dust more completely and thereby produce a higher-quality grain.

For a grain dryer of the type of the large Dri-All Model 328, this would represent about 72 bushels per hour of grain dust (2 percent of 3600 bushels per hour) with an equivalent heat energy of approximately 33,000,000 BTU's per hour. The existing model 328 burner has a heat capacity of 36,000,000 BTU's per hour. Therefore, potential grain-dust emissions are suitable to supply almost all of the heat energy required by such a grain-drying operation. Accordingly, a hazardous emissions problem is eliminated while saving the grain-dryer operator approximately 5 cents (for a five-point moisture reduction) or 10 cents (for a ten-point moisture reduction) per bushel handled. In this regard it is noteworthy that corn is presently at $2.30 per bushel.

Furthermore, in situations where the grain dust is not available in sufficient quantity, it is still economically attractive to burn product grain as a fuel in addition to available grain dust. The cost of available energy from corn, e.g., is approximately $4.42 per million BTU's, as compared to that from LP gas at approximately $5.22 per million BTU's. The LP tanks and fuel system for portable grain dryers can be replaced with a burner that can utilize pulverized or ground grain. The grain fuel may well be cheaper than existing LP fuel and, what may be even more important, it is readily available whenever and wherever grain-drying operations are effected.

Combustion tests using a powdered coal burner (known in the art) with finely-divided grain dust were effected in a furnace wherein the furnace-wall temperatures were between 2400° and 2800° F. (1318° and 1539° C. ). The grain dust burned reasonably well as CO levels were less than 100 parts per million.

The invention and its advantages are readily understood from the preceding description, and it is apparent that various changes may be made in the fuel, in the process of using it and in the apparatus in which it is employed without departing from the spirit and scope of the invention or sacrificing its material advantages. The fuels, the processes and the apparatus hereinbefore described are merely illustrative of preferred embodiments of the invention.

Reference is respectfully made to data provided by the following table:

| | Corn and/or Corn Starch | Wheat and/or Wheat Starch | Grain Dust | Oil | Coal | Gasoline | Natural Gas | Liquified Gas |
|---|---|---|---|---|---|---|---|---|
| Ignition temp. (°F.) | 716 | 716 | 806 | 700 | 1130 | 570/73 Oct<br>804/100 Oct | 900 to<br>1170 | 800 to<br>900 |
| Ignition Minimum Energy (Joules) | .02 | .02 | .03 | | .06 | .00024 | .00029 | .00029 |
| Ignition Minimum Concentration (oz/ft$^3$) | .040 | .025 | .055 | 1-6(1) | .055 | 1.4-7.6(1)<br>.116-.621 | 3.8-17(1)<br>.025-.11 | 2-9(1)<br>.013-.06 |
| Ignition Sensitivity(2) | 6.6 | 10.6 | 2.8 | | 1.0 | 190 | 500 | 1160 |
| Maximum Explosive Pressure (psig) | 115 | 105 | 115 | | 83 | 120 | 110 | 120 |
| Maximum Pressure Rise Rate (psi/sec)(5) | 9000 | 6500 | 5500 | | 2300 | (5) | 3,000 to<br>12,000 | 4000 |
| Explosive Severity(3) | 5.4 | 4.7 | 3.3 | | 1.0 | Very High<br>(e.g. >200) | 6.9 | 2.5 |
| Index Explosibility(4) | 35.6 | 49.8 | 9.2 | | 1.0 | Very High<br>(e.g. > 10,000) | 3400 | 2900 |
| Btu/lb | 9300<br>Shelled Dry | 8500<br>Dry Wheat<br>Straw | 8000<br>(dry)<br>6000<br>(wet) | 18,000 | 11,500<br>13,500 | 20,000 | 22,000 | 21,000 |
| Btu/ft$^3$ | 418,000 | 410,000 | 400,000<br>300,000 | 1,032,000 | 575,000<br>675,000<br>Loose<br>Shovelled | 935,000 | 1,000 | 720,000 |
| Estimated Cost ($ per) | 2.30/bushel<br>or 0.357/lb | 3.40/bushel<br>or 0.5667/lb | free<br>(?) | .42/gal | 35./ton<br>54./ton | .65/gal | 2.37/MCF | .50/gal |
| Cost/Energy ($/10$^6$ Btu's) | 4.42 | 6.67 | | 3.04 | 1.52<br>2.00 | 4.20 | 2.37 | 5.22 |
| Estimated Availability | 414 | | 1.6 | | 800 | | | |

-continued

| | Corn and/or Corn Starch | Wheat and/or Wheat Starch | Grain Dust | Oil | Coal | Gasoline | Natural Gas | Liquified Gas |
|---|---|---|---|---|---|---|---|---|
| (1980) (Million Metric Tons) | (All U.S. Grain) | | (emissions) | | | | | |

Footnotes - Table I (1)Explosive Limits (% by volume)

(2)Ignition Sensitivity = $\frac{\text{(Ign Temp} \times \text{Min Energy} \times \text{Min Concn) of Pittsburgh coal dust}}{\text{(Ign Temp} \times \text{Min Energy} \times \text{Min Concn) of sample dust}}$ (3)Explosive Severity = $\frac{\text{(Max expl press.} \times \text{Max rate of press. rise) of sample dust}}{\text{(Max. expl press.} \times \text{Max rate of press. rise) of Pittsburgh coal dust}}$ (4)Index Explosibility = Ignition Sensitivity × Explosive Severity (5)The pressure rise rate is dependent upon the surface area to volume ratio of the combustion vessel and the level of turbulence in the combustion mixture. Pressure rise rates in a gasoline internal combustion engine can approach 700,000 psi/sec.

What is claimed is:

1. A grain dryer having:

(a) three chamber means, the first of which has an outer shell which is intermediate of and spaced from that of each of the other two, the second of which is within the first chamber means, and the third of which surrounds a major portion of the first chamber means; a major portion of the outer shell of each of the first and second chamber means being perforated, whereas the outer shell of the third chamber means is impervious and extends beyond the perforated portion of the outer shell of the first chamber means;

(b) inlet means to introduce grain to be dried into the first chamber means and outlet means to withdraw from the same chamber means grain from which moisture has been removed, the inlet means and the outlet means being disposed at opposite ends of the first chamber means;

(c) grain-dust collecting means within the third chamber means and surrounding the first chamber means;

(d) means to conduct grain dust from the grain-dust collecting means to a grain-dust concentrating means; and (e) means to convey grain dust concentrated in the grain-dust concentrating means into the second chamber means and through a moisture removal means to a burner means within said second chamber means.

2. A grain dryer according to claim 1 wherein the burner means is a grain-dust burner means and concentrated and dried grain dust provides fuel means for sustaining said burner means.

3. A grain dryer having:

(a) first chamber means with perforated side walls and oppositely-disposed inlet and outlet ends, means at the inlet end to introduce grain to be dried and means at the outlet end to remove grain from which moisture has been removed;

(b) second chamber means with perforated side walls and an end wall within and spaced from counterparts of the first chamber means, the end wall being disposed adjacent the inlet end and facing the means to introduce grain to be dried; the space defined between the first and second chamber means constituting passage means to conduct grain from the inlet end to the outlet end; the second chamber means having disposed therein, intermediate the inlet and outlet ends, means for directing air toward said inlet end and through its perforated sidewalls and burner means disposed between the air-directing means and said end wall;

(c) means for concentrating grain dust, means for conveying concentrated grain dust from the concentrating means into the second chamber means and mens to charge thus-conveyed grain dust into the burner means, said grain dust constituting fuel means to sustain said burner means;

(d) said burner means being means to heat air which is directed past grain dust conveyed in the second chamber means and past grain in the passage means, thus providing, in combination with the air-directing means, means for removing moisture from both the grain dust fuel means and the grain.

4. A grain dryer according to claim 3 having:

(a) grain-dust collecting means surrounding the first chamber means and (b) means to conduct grain dust from the grain-dust collecting means to the grain dust concentrating means, the combined burner means and air-directing means providing means to heat grain dust in the grain-dust collecting means.

5. A grain dryer according to claim 3 or 4 having an outer impervious shell spaced from and substantially commensurate with perforated sidewalls of the first chamber.

6. A grain dryer according to claim 5 having means at its outlet end for cooling grain from which moisture has been removed.

* * * * *